United States Patent [19]

Kuramochi

[11] Patent Number: 4,769,913

[45] Date of Patent: Sep. 13, 1988

[54] FUZZ REMOVER

[76] Inventor: Shigeaki Kuramochi, No. 24-17, Koishikawa 5-Chome, Bunkyo-Ku, Tokyo, Japan

[21] Appl. No.: 943,040

[22] Filed: Dec. 18, 1986

[30] Foreign Application Priority Data

Dec. 28, 1985 [JP] Japan ..... 60-204311

[51] Int. Cl.[4] ..... B26B 29/00

[52] U.S. Cl. ..... 30/286; 30/333

[58] Field of Search ..... 30/30, 51, 286, 333; 15/104 A, 236 R

[56] References Cited

U.S. PATENT DOCUMENTS

| | | | |
|---|---|---|---|
| 841,729 | 1/1907 | Smith | 30/333 X |
| 1,602,262 | 10/1926 | Hilser | 30/30 |
| 1,782,455 | 11/1930 | Baker | 30/333 X |
| 2,488,436 | 11/1949 | Santoro | 30/30 |
| 2,869,229 | 1/1959 | Hightower | 30/30 |
| 3,383,764 | 5/1968 | Sachs | 30/51 X |

*Primary Examiner*—E. R. Kazenske
*Assistant Examiner*—Michael D. Folkerts
*Attorney, Agent, or Firm*—James E. Nilles; James R. Custin

[57] ABSTRACT

A fuzz remover wherein a blade having cutting edges at side edge portions thereof is held between a fuzz remover body having at both side edge portions thereof a plurality of teeth each of which projects therefrom in upwardly-inclined state and a bottom member attached to the lower surface of said fuzz remover body. The cutting edges of the blade project from the side edge portions of the fuzz remover body and the teeth project beyond the cutting edges. The outer ends of the teeth are connected by connectors.

1 Claim, 1 Drawing Sheet

FUZZ REMOVER

BACKGROUND OF THE INVENTION

1. Field of the Invention

This invention relates to a fuzz remover used to remove fuzz occurring on a woven material, a knitted material or a blanket, and more particularly to a fuzz remover adapted to remove fuzz by cutting the same with a blade.

2. Description of the Prior Art

A conventional fuzz remover of this kind employs a structure in which a file-like edge net portion is provided at a side edge section of, for example, a plate type fuzz remover body, and it is used by rubbing this file-like edge net portion against a fuzz-carrying woven or knitted material to thereby scratch off the fuzz.

The fuzz remover of this conventional construction is designed so that the file-like edge net portion thereof is rubbed directly against a woven or knitted material. Consequently, the fibers in a knitted woollen material are hurt.

SUMMARY OF THE INVENTION

An object of the present invention is to obtain a fuzz remover having an improved slidability of a fuzz remover body and capable of removing fuzz reliably and efficiently without damaging the fuzz-carrying fibers.

The fuzz remover according to the present invention is characterized in that it is provided with a fuzz remover body having at both side edge portions thereof a plurality of teeth each of which projects upward and outward so that the lower surface of the outer end portion of each tooth is inclined upward, and each of which has a stepped portion in the lower surface thereof; a blade having cutting edges along opposite sides thereof and attached to the lower surface of the fuzz remover body with the cutting edges engaged with the stepped portions of the teeth on the fuzz remover body; and a bottom member attached to the lower surface of the fuzz remover body so that the blade is held between the bottom member and the fuzz remover body with the cutting edges of the blade projecting from the side edge portions of the fuzz remover body. This fuzz remover is adapted to have its blade reliably cut off the fuzz on a woven or knitted material, which during an operation of the fuzz remover enters the spaces between the teeth of the fuzz remover body, without damaging the fibers in the material as the material is scratched and levelled by the teeth with the teeth not caught by the material, which teeth are provided at both side edges of the fuzz remover body so as to project upward in such a manner that the lower surfaces of the outer end portions of the teeth are inclined upward, the blade being provided on the lower side of the fuzz remover body and held by the bottom member with the cutting edges of the blade engaged with the stepped portions on the lower surfaces of the teeth and positioned close to the knitted material.

The fuzz remover according to the present invention is also characterized in that connectors which are joined at their lower surfaces to the lower edges of a plurality of teeth formed on the fuzz remover body are provided between the outer ends of and integrally with these teeth. This fuzz remover is adapted to cut off reliably by the blade thereof the fuzz on a woven or knitted material, which enters during an operation of the fuzz remover the spaces between the teeth of the fuzz remover body and the connectors between the outer ends thereof, without damaging the fibers in the material as the material is scratched and levelled by the teeth with the catching of the material on the teeth reliably prevented, which teeth are provided at both side edges of the fuzz remover body so as to project upward in such a manner that the lower surfaces of the outer end portions of the teeth are inclined upward, the connectors being provided between the upper ends of and integrally with the teeth, the blade being provided on the lower side of the fuzz remover body and held by the bottom member with the cutting edges of the blade engaged with the stepped portions on the lower surfaces of the teeth and positioned close to the knitted material.

According to the present invention, stepped portions are formed on the teeth provided so as to project upward from the side edge portions of the fuzz remover body, and the blade is attached to the lower surface of the fuzz remover body with the cutting edges of the blade engaged with these stepped portions, the bottom member being then attached to the lower side of the fuzz remover body with the cutting edges projecting outward from the side edges thereof, so that the blade is held by the bottom member. Accordingly, this fuzz remover is capable of cutting off the fuzz present on a fiber material, such as a woven material and a knitted material, without hurting the material and fingers. Also, the cutting efficiency can be improved by bringing the cutting edge closer to the woven material, and the strength of the teeth can be improved by increasing the width thereof.

According to the present invention, the lower edges of the outer end portions of the teeth are inclined upward, and connectors are provided between and integrally with the outer end portions of the teeth. Accordingly, while the fuzz remover body is slid along the surface of a knitted material, the catching of the teeth on the material can be prevented reliably, and the slidability of the fuzz remover can be improved greatly. Moreover, since fuzz enters the spaces between a plurality of teeth and connectors therebetween without being crushed by the bottom member, it can be cut off reliably and efficiently.

The above and other objects as well as the features of the invention will become clear from the following description of a preferred embodiment taken in conjunction with the accompanying drawings.

DESCRIPTION OF THE PREFERRED EMBODIMENT

Figure 2:
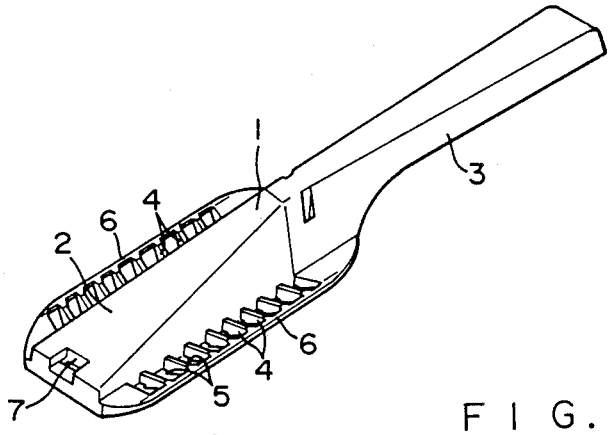
FIG. 2 is an exploded view in perspective of the same embodiment.
Figure 1:
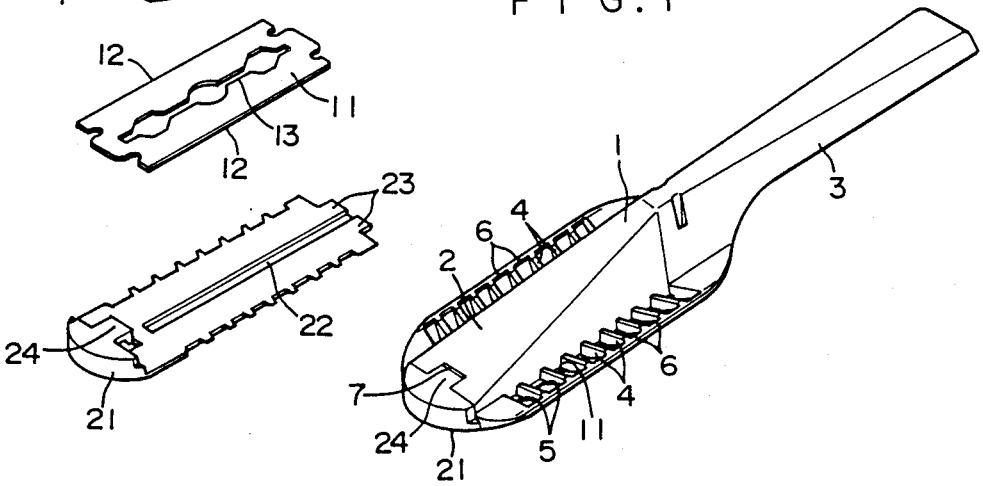
FIG. 1 is a perspective view of an embodiment of the fuzz remover according to the present invention, which is taken from the upper side of the embodiment.
Figure 3:
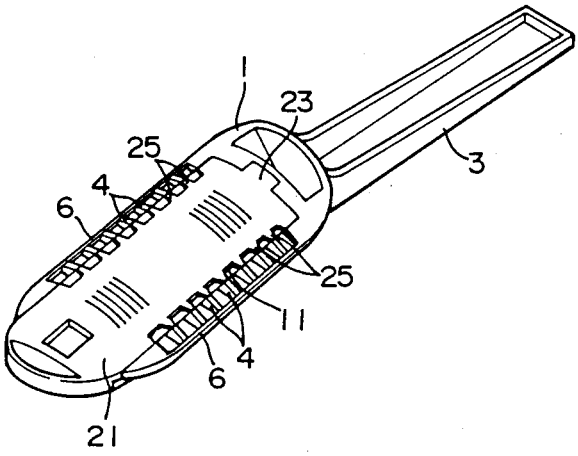
FIG. 3 is a perspective view of the same embodiment in assembled state, which is taken from the lower side of the embodiment.

The construction of an embodiment of the fuzz remover according to the present invention will now be described with reference to FIGS. 1–3.

Reference numeral 1 denotes a fuzz remover body molded out of a synthetic resin, which consists of an elongated-box type body member 2 having a substantially flat lower surface, and a handle 3 formed integrally with and projecting lengthwise from one end of this body member 2. A plurality of projecting teeth 4 are formed on and integrally with both of the longer edge portions of the lower surface of the body member 2. The lower edges of these teeth 4 are inclined arcuately in the upward direction from the central portion of the body member 2 toward the outer sides thereof. A stepped portion 5, the height of which is substantially equal to the thickness of a blade 11 which will be described later, is formed at the end section of each of these lower edges of the teeth which is adjacent to the central portion of the body member 2, and the portion of the lower edge of each tooth 4 which extends from this stepped portion toward the central portion of the body member 2 is flush with the lower surface of the body member 2. Rod type connectors 6 extending in the lengthwise direction of the body member 2 are formed between the outer end portions of the teeth 4 and integrally with the fuzz remover body 1, the lower surfaces of these connectors 6 and the lower edges of the teeth 4 being smoothly continuous with each other.

A projection (not shown) extending in the lengthwise direction of the body member 2 is formed on the lower surface thereof. A locking recess (not shown) is provided at the rear end portion of the body member 2, i.e. the end portion thereof which is adjacent to the handle 3, which locking recess opens towards the front end portion thereof which is opposite the handle 3. A cross-sectionally L-shaped locking recess 7 is formed at the front end portion of the upper surface of the body member 2.

The blade 11 is made of a metallic material to a substantially oblong shape which is similar to the shape of a razor-edge, and the length of a shorter side, i.e. the width of the blade 11 is set equal to the distance between the opposite stepped portions of the teeth 4 formed on both side edge portions of the fuzz remover body 1. Both of the longer side edge portions of the blade 11 are formed as cutting edges 12. The blade 11 is further provided with a lengthwise-extending locking slot 13.

Reference numeral 21 denotes a substantially oblong plate type bottom member consisting of a synthetic and having a flat upper surface, and the width of this bottom member 21 is slightly smaller than that of the blade 11. The bottom member 21 has a transversely arcutate lower surface, and the thickness thereof decreases gradually toward both sides thereof, the lower and upper surfaces of the bottom member meeting at both side edges thereof. The bottom member 21 is provided in its upper surface with a groove 22 extending in the lengthwise direction thereof to the rear end thereof. It is further provided at its rear end portion with locking projections 23 formed so as to have the rear end portion of the groove 22 therebetween, and at its front end portion with a locking claw 24 having a substantially L-shaped side elevational view and projecting in the rearward direction.

The bottom member 21 is also provided at both side edge portions thereof with projections 25 abutting on the teeth on the fuzz remover body 1, in such a manner that the fuzz remover body 1 can be slid smoothly on the surface of a woven material during a fuzz-removing operation.

The operation of this embodiment will now be described.

In order to assemble this fuzz remover, first, the locking slot 13 in the blade 11 is fitted around the projection (not shown) formed on the lower surface of the fuzz remover body 1, and the blade 11 is set on the lower surface of the fuzz remover body 1 with the cutting edges 12 of the former engaged with the stepped portions 5 of the teeth 4 on the fuzz remover body 1. The groove 22 in the bottom member 21 is then engaged with the projection on the fuzz remover body 1, and the bottom member 21 is then slid rearward with respect to the fuzz remover body 1. Consequently, the locking projections 23 and locking claw 24 on the bottom member 21 engage with the locking recess (not shown) and locking recess 7 in the fuzz remover body 1, so that the bottom member 21 is secured to the lower surface of the fuzz remover body 1. In the product thus assembled, the blade 11 is held between the fuzz remover body 1 and bottom member 21, and the cutting edges 12 thereof project slightly from the side edges of the bottom member 21 to positions close to the outer surface of the bottom member 21, the blade 11 being retained in this state.

When this fuzz remover is put to use, the lower surface thereof is pressed against a woven material, a knitted material or a blanket, and the fuzz remover body 1 is then slid in the widthwise direction thereof. The fuzz on the woven material is then cut off by the cutting edges 12 of the blade 11 as the fibers in the woven material are scratched and levelled by the teeth 4.

The teeth 4 are inclined at their outer lower ends in the inward downward direction, and rod type connectors 6 extending at right angles to the sliding direction of the fuzz remover body 1 are formed between and integrally with the outer ends of these teeth 4. Therefore, even when the meshes of the knitted material to which this fuzz remover is applied are large, the catching of the fibers on the teeth 4 can be prevented reliably, and the fuzz remover body 1 can be slid on the material very smoothly.

The teeth 4 are thus provided, and the blade 11 is set on the fuzz remover body 1 with the cutting edges 12 engaged with the stepped portions 5 formed on the teeth 4, the blade 11 being retained by the bottom member 21 the thickness of which decreases gradually toward both sides thereof. Accordingly, while the fuzz remover is moved slidingly on a knitted material, the fuzz enters the bore-like hollows between the teeth 4 and connectors 6 without being crushed by the lower surface of the bottom member 21, and is then cut off reliably by the cutting edges 12. Since the cutting edges 12 are engaged with the stepped portions of the teeth 4, the body of the knitted material is not cut with, or the hand is not hurt by, the cutting edges 12, though the cutting edges 12 extend close to the material.

The teeth 4 are provided on the fuzz remover body 1 so that the teeth 4 are positioned above the blade 11. Hence, the fuzz-cutting efficiency can be improved by reducing the distance between the lower surface of the bottom member 21 and cutting edges 12, and the strength of the teeth 4 can be improved by increasing the thickness thereof.

In order to renew the blade 11, the bottom member 21 is slid forward with respect to the fuzz remover body 1, and the locking recess (not shown) and locking recess 7 in the fuzz remover body 1 and the locking members 23 and locking claw 24 on the bottom member 21 are disengaged from each other. The bottom member and blade 11 are then removed from the fuzz remover body 1, and a new blade 11 may thereafter be set on the fuzz remover body 1.

What is claimed is:

1. A device for removing fuzz from fabric and the like, characterized by:

A. a substantially flat blade that defines a plane and has (1) a substantially straight cutting edge in said plane and (2) opposite top and bottom blade surfaces;

B. a holder for said blade that comprises cooperating upper and lower holder members between which the blade is confined, (1) said upper holder member having a downwardly facing blade engaging surface that overlies the top surface of the blade, (2) said lower holder member having (a) an upwardly facing blade engaging surface that underlies the bottom surface of the blade and (b) a bottom surface that is below said plane and is curved transversely to said cutting edge to a convexly arcuate profile, (3) each said holder member having a side surface at which its blade engaging surface terminates and which extends substantially parallel to said cutting edge and is spaced laterally inwardly therefrom, and (4) said upper holder member having an elongated handle portion that projects upwardly away from the blade and lengthwise away from said upper holder member in one direction substantially parallel to said cutting edge on the blade;

C. said upper holder member having tooth portions which project laterally outwardly from its said side surface and which provide elongated teeth for the holder that are spaced from one another along the length of said cutting edge, each said tooth (1) extending across and beyond the cutting edge and (2) having a bottom surface which merges into said bottom surface of the lower holder member at a level below said plane and extends obliquely upwardly and laterally outwardly therefrom to a tip of the tooth that is spaced laterally outwardly from said cutting edge and is above the level of said plane, and (3) the lower edge of each tooth (a) having an upwardly stepped portion laterally outwardly adjacent to said side surface of the upper holder member that is coplanar with said downwardly facing blade engaging surface and wherein the cutting edge portion of the blade is received, and (b) being inclined upwardly and laterally outwardly from said step portion to the tip of the tooth; and D. said upper holder member having an elongated rod-like connector joined to the tip of each of said teeth and extending parallel to said cutting edge in laterally outwardly spaced relation thereto and above said plane.

* * * * *